US009803862B2

(12) United States Patent
Masen et al.

(10) Patent No.: US 9,803,862 B2
(45) Date of Patent: Oct. 31, 2017

(54) CONTROL SYSTEM AND METHOD FOR A SOLID FUEL COMBUSTION APPLIANCE

(75) Inventors: Mark Masen, Leonard, MI (US); Alex Manoulian, Jr., New Boston, MI (US)

(73) Assignee: MAXITROL COMPANY, Southfield, MI (US)

( * ) Notice: Subject to any disclaimer, the term of this patent is extended or adjusted under 35 U.S.C. 154(b) by 984 days.

(21) Appl. No.: 13/113,669

(22) Filed: May 23, 2011

(65) Prior Publication Data

US 2011/0300494 A1 Dec. 8, 2011

Related U.S. Application Data

(60) Provisional application No. 61/351,477, filed on Jun. 4, 2010.

(51) Int. Cl.

| | |
|---|---|
| ***F23N 1/02*** | (2006.01) |
| ***F23N 5/10*** | (2006.01) |
| ***F23B 90/08*** | (2011.01) |
| ***F23N 3/04*** | (2006.01) |
| ***F24B 1/02*** | (2006.01) |

(52) U.S. Cl.

CPC ..... *F23N 5/102* (2013.01); *F23B 90/08* (2013.01); *F23N 3/042* (2013.01); *F24B 1/028* (2013.01); *F23N 2023/38* (2013.01); *F23N 2025/10* (2013.01); *F23N 2035/06* (2013.01); *F23N 2037/12* (2013.01); *F23N 2041/02* (2013.01)

(58) Field of Classification Search

CPC ..... F23N 3/00; F23N 1/02; F23N 5/00; F23N 5/102; F23N 3/042; B01D 53/74; F24B 13/04; F24B 1/028; F24B 90/08; F23L 1/02; F23L 9/04

USPC ..... 431/12; 110/190

See application file for complete search history.

(56) References Cited

U.S. PATENT DOCUMENTS

| | | | | |
|---|---|---|---|---|
| 741,474 | A * | 10/1903 | Ferry | F24C 15/02 126/21 R |
| 2,032,252 | A * | 2/1936 | Burrow | F24B 5/04 126/15 R |
| 3,168,088 | A * | 2/1965 | Martin | F24B 5/026 126/77 |
| 3,669,039 | A | 6/1972 | Leman | |
| 3,669,041 | A * | 6/1972 | Schworer | 110/193 |

(Continued)

FOREIGN PATENT DOCUMENTS

| | | |
|---|---|---|
| EP | 0624756 B1 | 2/1997 |
| EP | 1356734 B1 | 1/2007 |

(Continued)

*Primary Examiner* — Avinash Savani
*Assistant Examiner* — George R Blum
(74) *Attorney, Agent, or Firm* — Howard & Howard Attorneys PLLC

(57) ABSTRACT

A control system for a solid fuel combustion appliance, e.g., a wood burning stove, includes a temperature sensor for sensing an output temperature of the appliance. A controller receives the output temperature and controls a damper associated with air flow through the stove to maintain a predetermined temperature. The system also includes a detector that senses certain conditions of the solid fuel, e.g., wood, that is burned by the stove. When additional fuel is added to the appliance, the system temporarily encourages initial combustion of the new fuel, before returning to maintaining the predetermined temperature.

17 Claims, 2 Drawing Sheets

(56) References Cited

U.S. PATENT DOCUMENTS 3,723,047 A * 3/1973 Baudelet de Livois ..... 431/76
3,982,525 A * 9/1976 Herman ..... F24H 3/00 126/116 R
4,030,479 A * 6/1977 Webb ..... F23L 3/00 110/158
4,136,662 A 1/1979 Willson
4,200,086 A * 4/1980 Kolb ..... F24B 1/02 126/61
4,235,171 A * 11/1980 Leonard ..... 110/188
4,252,104 A * 2/1981 Morris ..... F24B 5/028 126/1 E
4,253,404 A * 3/1981 Leonard ..... 110/188
4,263,887 A * 4/1981 Dowdall ..... 126/116 A
4,267,818 A * 5/1981 Taylor ..... F24B 1/19 126/518
4,279,237 A * 7/1981 dePencier ..... F24B 1/192 126/285 A
4,304,217 A * 12/1981 McGinn ..... F23M 11/02 126/286
4,309,965 A 1/1982 Hill
4,312,278 A 1/1982 Smith et al.
4,321,879 A * 3/1982 Toivo ..... F23B 50/12 110/267
4,342,306 A 8/1982 Thulman et al.
4,350,141 A * 9/1982 Miller ..... F23M 11/02 110/175 R
4,355,587 A 10/1982 Lemon
4,362,146 A 12/1982 Schuller
4,374,569 A * 2/1983 Hayes ..... F23N 1/062 236/1 G
4,387,699 A 6/1983 Murch, Jr.
4,442,825 A * 4/1984 Waldau ..... F24B 13/04 110/101 CC
4,457,294 A * 7/1984 Cumpston ..... F23L 13/00 126/112
4,461,275 A 7/1984 Lucas
4,469,083 A 9/1984 Helle et al.
4,474,549 A * 10/1984 Capone ..... F23N 1/025 236/15 E
4,492,560 A * 1/1985 Sundberg ..... 431/12
4,556,044 A 12/1985 Barsness et al.
4,675,029 A 6/1987 Norman et al.
4,681,087 A 7/1987 Meeker
4,712,095 A * 12/1987 Georgis, II ..... F24B 1/028 340/584
4,766,876 A * 8/1988 Henry ..... F24B 5/028 126/193
4,862,869 A 9/1989 Hazard
5,007,404 A 4/1991 Hall et al.
5,014,680 A 5/1991 Siemer
5,033,363 A * 7/1991 King ..... A23L 7/183 426/233
5,179,933 A 1/1993 McCrillis et al.
5,391,074 A * 2/1995 Meeker ..... 431/6
5,873,356 A 2/1999 Vossler et al.
6,096,100 A * 8/2000 Guldi ..... B08B 5/02 134/21
7,457,689 B2 11/2008 Nelson et al.
8,627,775 B1 * 1/2014 Wilson ..... F23L 1/02 110/147
2001/0042610 A1 * 11/2001 Lyons ..... F24B 1/1808 165/47
2003/0098358 A1 * 5/2003 Lyons ..... F24B 1/1808 237/55
2004/0244791 A1 12/2004 Henry et al.
2007/0068506 A1 * 3/2007 Lundberg ..... F24B 13/04 126/68
2007/0289589 A1 * 12/2007 McFarland ..... F24B 1/028 126/502
2008/0041357 A1 * 2/2008 Brown ..... F23L 9/02 126/77
2008/0097649 A1 4/2008 Nelson et al.
2008/0223266 A1 9/2008 Brazier et al.
2009/0183693 A1 * 7/2009 Furman ..... F23B 50/06 122/16.1
2010/0186645 A1 * 7/2010 Tiegs ..... 110/345
2010/0326421 A1 12/2010 Atemboski et al.
2011/0008214 A1 * 1/2011 Haas ..... B01D 53/74 422/105
2011/0094496 A1 * 4/2011 McCown ..... 126/289

FOREIGN PATENT DOCUMENTS

WO 8701432 A1 3/1987
WO 9635912 A1 11/1996
WO WO2009144393 A1 * 12/2009
WO 2010101171 A1 10/2010

* cited by examiner

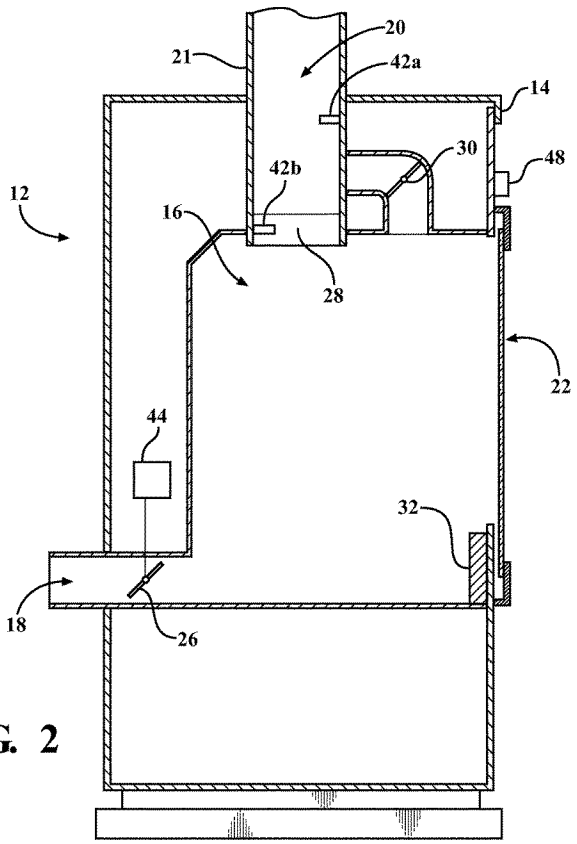
FIG. 2
FIG. 1
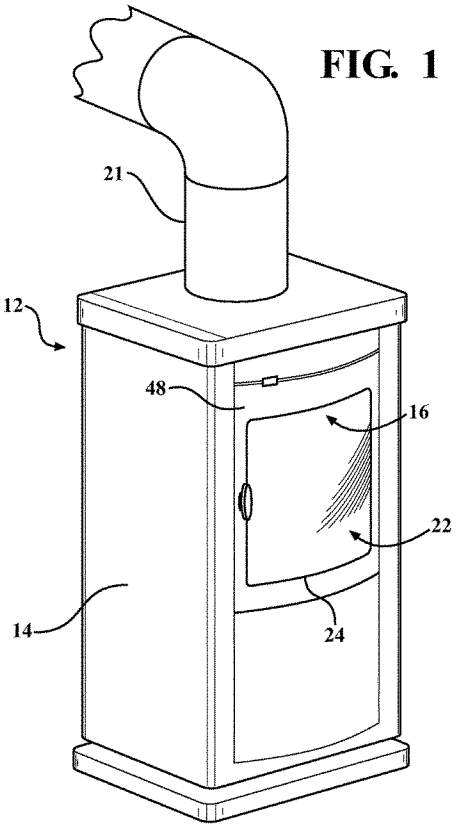

CONTROL SYSTEM AND METHOD FOR A SOLID FUEL COMBUSTION APPLIANCE

CROSS REFERENCE TO RELATED APPLICATION

This application claims the benefit of provisional patent application No. 61/351,477, filed Jun. 4, 2010, which is hereby incorporated by reference.

BACKGROUND OF THE INVENTION

1. Field of the Invention

The invention relates to computerized control systems and methods for solid fuel combustion appliances, e.g., wood stoves.

2. Description of the Related Art

Wood burning stoves have a long and distinguished history for providing heating for houses and enclosures of every sort. The efficiency of such stoves has been steadily increasing in recent years, especially with the addition of catalysts to lower the burning temperature of the solid fuel. However, there still remains the possibility of higher efficiency and greater temperature control over such stoves.

BRIEF SUMMARY

The application describes a control system for a solid fuel combustion appliance. The appliance includes a housing defining a combustion chamber and an inlet, an outlet, and an opening, each in fluidic communication with the combustion chamber. The appliance also includes an inlet damper movable between a plurality of positions for controlling airflow into the inlet. The system includes a drive mechanism operatively connected to the inlet damper for controlling the position of the inlet damper. An exhaust temperature sensor measures the temperature of air exhausted through the outlet. The system also includes a detector for signaling a certain condition of the solid fuel in the combustion chamber. A controller is in communication with the drive mechanism, the exhaust temperature sensor, and the detector. The controller controls the drive mechanism to position the inlet damper to maintain a predetermined temperature of airflow through the outlet. The controller also controls the drive mechanism to position the inlet damper at a predetermined position for a predetermined period of time in response to the detector signaling the certain condition of the solid fuel in the combustion chamber regardless of the predetermined temperature.

As such, the control system regulates the temperature output of the stove utilizing precise control over the inlet damper. Furthermore, when the user adds new fuel, e.g., wood, to the combustion chamber, the control system automatically controls the inlet damper to ensure that the new fuel is quickly ignited so that its rate of burn can also be precisely controlled.

BRIEF DESCRIPTION OF THE DRAWINGS

Other advantages of the disclosed subject matter will be readily appreciated, as the same becomes better understood by reference to the following detailed description when considered in connection with the accompanying drawings wherein:

FIG. 1 is a perspective view of an exemplary solid fuel combustion appliance for use with the control system and method;

FIG. 2 is an cross-sectional view of an exemplary solid fuel combustion appliance.

DETAILED DESCRIPTION

Figure 3:
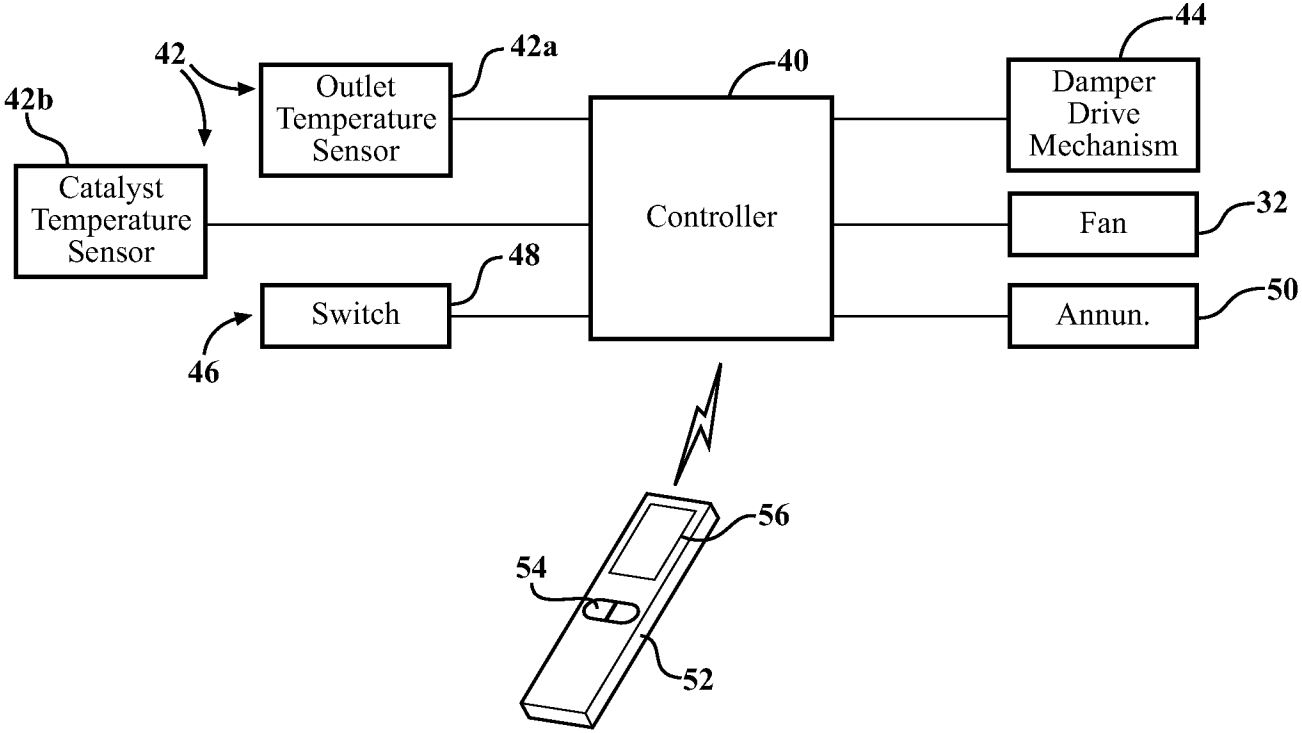
FIG. 3 is an electrical block diagram of the control system.

Referring to the Figures, wherein like numerals indicate like parts throughout the several views, a control system 10 is shown herein.

The control system 10 is preferably used in conjunction with a solid fuel combustion appliance 12, as shown in FIG. 1. The appliance 12 may be alternatively referred to as a stove, a fireplace, a burner, or other name as appreciated by those skilled in the art. The solid fuel (not shown) burned with the appliance 12 may be wood, biomass, coal, charcoal, or other solid known to those skilled in the art. The solid fuel may be in log, pellet, chip, powder, briquette, or other suitable form known to those skilled in the art and typically dependent on the specific design and configuration of the appliance 12.

Referring now to FIG. 2, the appliance 12 includes a housing 14 defining a combustion chamber 16. The combustion chamber 16 may also be referred to by those skilled in the art as a "firebox". The housing 14 defines an inlet 18 and an outlet 20, each in fluidic communication with the combustion chamber 16. The inlet 18 supplies air to the combustion chamber 16 while the outlet 20 serves to exhaust combustion gases. In the illustrated embodiment, a chimney 21 is fluidically connected to the outlet 20 to exhaust the combustion gases to atmosphere, outside of a structure (not shown) where the appliance 12 is located, as is well known to those skilled in the art.

The housing 14 may further define an opening 22 in fluidic communication with the combustion chamber 16. The opening 22 may be utilized to add the solid fuel to the combustion chamber 16. In the illustrated embodiment, as shown in FIG. 1, a door 24 is operatively connected to the housing 14. For instance, the door 24 may be connected to the housing 14 with hinges (not shown). The door 24 is preferably positionable in a plurality of positions including a closed position to block the opening 22. The opening 22 may be completely or at least partially blocked by the door 24 depending on the design and configuration of the appliance 12.

In one embodiment, the door 24 is manually opened by a user for adding solid fuel to the combustion chamber 16. In other embodiments, the solid fuel may be added automatically. For instance, an auger (not shown) may feed the solid fuel, especially in pellet form, through the opening 22 and to the combustion chamber 16.

Referring again to FIG. 2, the appliance 12 further includes an inlet damper 26. The inlet damper 26 is in fluidic communication with the inlet 18 and movable between a plurality of positions for controlling the flow of air into the inlet 18 and, as such, controlling the flow of air into the combustion chamber 16. The appliance 12 may also include an outlet damper (not shown) for closing off the outlet 20, e.g., when the appliance 12 is not in use.

The appliance 12 may also include a catalyst 28 fluidically disposed between the combustion chamber 16 and the outlet 20. As such, combustion gases pass through the catalyst 28 prior to being exhausted through the outlet. Those skilled in the art realized that the catalyst 28, often referred to as a catalytic converter, changes the rate of the chemical reaction, which, in this case, is the combustion or burning of the solid fuel. In particular, the catalyst 28 of the combustion appliance 12 lowers the temperature at which smoke can catch fire. The appliance 12 may further include a catalyst damper 30 to allow the combustion gases to pass through the catalyst 28 or to bypass the catalyst 28.

The appliance 12 may also include a fan 32 for blowing air from the combustion chamber to a space outside the housing 14. That is, the fan 32 may blow heated air from inside the housing 14 to outside the housing 14. Control of the fan 32 will be described in further detail hereafter.

Referring now to FIG. 3, the control system 10 includes a controller 40. The controller 40 controls various aspects of the combustion performed by the solid fuel combustion appliance 12 as described herein. In the illustrated embodiment, the controller 40 is programmable and executes a software program. The controller 40 may be implemented as a microcontroller, microprocessor, application specific integrated circuit, or other suitable device or combination of devices capable of performing the functions described herein. The control system 10 may also include an analog-to-digital converter ("ADC") and a digital-to-analog converter ("DAC") for converting signals as is well known to those skilled in the art. The ADC and DAC may be integrated with the controller 40 or separate therefrom.

The control system 10 includes at least one temperature sensor 42. The at least one temperature sensor 42 may be implemented as a thermocouple, a resistive temperature detector ("RTD"), infrared thermometer, or other suitable device as appreciated by those skilled in the art. The at least one temperature sensor 42 is in communication with the controller 40. Typically, the at least one temperature sensor 42 is electrically connected to the ADC which produces a digital value corresponding to the measured temperature to the controller 40. Of course, other techniques for transferring temperature data from the temperature sensor 42 to the controller 40 are realized by those skilled in the art.

In one embodiment, the at least one temperature sensor 42 is implemented as an exhaust temperature sensor 42*a*. The exhaust temperature sensor 42*a* measures the temperature of air exhausted through the outlet 20. In the illustrated embodiment, the exhaust temperature sensor 42*a* is disposed in the chimney 21 adjacent the outlet 20. However, other suitable locations for positioning the exhaust temperature sensor 42*a* will be realized by those skilled in the art.

In another embodiment, the at least one temperature sensor 42 is implemented as the exhaust temperature sensor 42*a* and a catalyst temperature sensor 42*b*. The catalyst temperature sensor 42*b* measures the temperature of air passing through the catalyst 28. Accordingly, the catalyst temperature sensors 42*b* is disposed adjacent to the catalyst 28 or integrated within the catalyst 28.

The control system 10 also includes a drive mechanism 44 operatively connected to the inlet damper 26. The drive mechanism 44 controls the position of the inlet damper 26. As just one example, the drive mechanism 44 may control the position of the inlet damper 26 at five degree increments (e.g., 0% open, 5% open, 10% open, . . . 95% open, 100% open). The drive mechanism 44 is preferably a motor (not separately numbered) having a mechanical linkage (not shown) to the damper 26. However, other devices may be implemented as the drive mechanism 44. The drive mechanism 44 is in communication with the controller 40 such that the controller 40 issues commands and/or signals to the drive mechanism 44 for controlling the position of the inlet damper 26.

The control system 10 may further include a detector 46 for signaling a certain condition of the solid fuel in the combustion chamber 16. The detector 46 is in communication with the controller 40 such that the controller 40 receives a signal when the certain condition of the solid fuel is ascertained. In the illustrated embodiment, the certain condition is the addition of solid fuel.

The detector 46 of the illustrated embodiment is implemented as a switch 48 electrically connected to the controller 40. In one technique, the switch 48 is coupled to the housing 14 to operatively engage the door 24 to signal when the door 24 has been opened and reclosed. The opening and reclosing of the door 24 thus signals the addition of solid fuel to the combustion chamber 16. In another technique, the switch 48 is disposed in a position allowing the user to manually depress the switch 48, thus signaling the addition of solid fuel to the combustion chamber 16. In yet another technique, the switch 48 is operatively connected to the auger to sense when the auger is adding solid fuel to the combustion chamber 16.

The detector 46 may be implemented with devices other than the switch 48 in other embodiments. In one example, an optical device (not shown) may be utilized to sense when the door 24 is opened and reclose or when additional solid fuel is added to the combustion chamber 16. In another example, a capacitive sensor (not shown) may be implemented to sense the amount of solid fuel in the combustion chamber 16 and thus determine whether additional sold fuel has been added.

The controller 40 may also be in communication with the fan 32 for controlling operation of the fan 32. For example, the controller 40 may operate a relay (not shown) for turning the fan 32 on and off. Alternatively, the controller 40 may be electrically connected to a motor (not shown) of the fan 32 to more precisely control the speed of the fan 32, and thus the airflow produced by the fan 32.

The control system 10 of the illustrated embodiment further includes an annunciator 50 in communication with the controller 40. The annunciator 50 may be implemented as any device capable of providing information to the user. For instance, the annunciator 50 may be implemented as a light, a display, and/or a speaker. Those skilled in the art will realize other techniques to implement the annunciator 50.

The control system 10 may further include a remote control device 52 in communication with the controller 40 such that commands and/or data may be sent back-and-forth between the remote control device 52 and the controller 40. The communications between the controller 40 and the remote control device 52 may be implemented via radio frequency (RF) signals, optical signals (e.g., infrared or ultraviolet), or a combination of RF and optical signals. Those skilled in the art realize other techniques for facilitating communications between the remote control device 52 and the controller 40.

The remote control device 52 allows the user to control operation of the controller 40 and to receive information from the controller 40. The remote control device 52 of the illustrated embodiment includes a plurality of pushbuttons 54 for receiving input from the user and a display 56 for providing information to the user. Of course, other techniques for receiving input from the user and providing information to the user may alternatively be implemented.

In addition to or as a substitute to the remote control device 52, the control system 10 may also include pushbuttons, switches, keypads, or other controls (none of which are shown) electrically connected to the controller 40. For instance, DIP switches (not shown) may be mounted on a printed circuit board (not shown) which also supports the controller 40.

In the illustrated embodiment, the controller 40 operates an automatic mode or a manual mode. In the automatic mode, the controller 40 generally attempts to control for output temperature of the combustion. In the illustrated embodiment, the mode of the controller 40 is controlled utilizing the remote control device 52.

In one aspect of automatic mode, the controller 40 controls the drive mechanism 44 to position the inlet damper 26 to maintain a predetermined temperature of airflow through the outlet 20. The predetermined temperature may actually be a range of temperatures. For instance, in one implementation, the predetermined temperature may range from 260° C. to 280° C. As such, the controller 40 may incrementally close the inlet damper 26 as the temperature rises and approaches or exceeds 280° C. to reduce the amount of air, and consequently oxygen, that is available to the fire. Likewise, the controller 40 may incrementally open the inlet damper 26 as the temperature falls and approaches or passes 260° C. The control of the temperature of airflow through the outlet 20 may be implemented with a proportional-integral (PI) or proportional-integral-derivative (PID) techniques, or other suitable techniques.

When additional solid fuel is added to the combustion chamber 16, it is advantageous to provide for maximum airflow to the combustion chamber 16 in order to fully ignite and envelop the additional solid fuel. As such, in automatic mode, the controller 40 preferably reacts to the certain condition of the solid fuel sensed by the detector 46. Specifically, the controller 40 does not strictly control for temperature when new solid fuel is added to the combustion chamber 16. Instead, in response to the certain condition of the solid fuel, the controller 40 controls the drive mechanism 44 to position the inlet damper 26 at a predetermined position for a predetermined period of time regardless of the predetermined temperature. In the illustrated embodiment, the controller 40 controls the drive mechanism 44 to position the inlet damper 26 at a fully open position for about one minute. After the predetermined period of time has expired, the controller 40 returns to controlling for the predetermined temperature of airflow through the outlet 20.

The controller 40 may also provide for other control techniques in automatic mode. In another aspect of the automatic mode, the controller 40 controls the drive mechanism 44 based on temperature of the room, i.e., the area outside of the appliance 12 itself. This is accomplished with a thermostat (not shown) or other device in communication with the controller 40. Furthermore, the controller 40 may also provide for different conditions of the solid fuel. For instance, the controller 40 may include a "wet wood" automatic mode. In this mode, the controller 40 will control for a higher temperature output due to the wet nature of the solid fuel.

The predetermined temperature of airflow may be controlled by the user. For instance, in a "long-burn" automatic mode, the predetermined temperature is set very low, but still high enough to support combustion. In another instance, in a "high output" automatic mode, the predetermined temperature is at or near a maximum safe operating temperature.

In the manual mode, the user may control some or all of the control elements of the system 10 manually. In the illustrated embodiment, the user may utilize the remote control device 52 to manually open and close the inlet damper to maintain control over the temperature output from the appliance 12.

In the illustrated embodiment, the controller 40 receives both the temperature of the air passing through the outlet 20 and the temperature of the air passing through the catalyst 28. By analyzing these two temperatures, the controller 40 determines when the solid fuel is expiring. Specifically, when both temperatures fall by a predetermined amount for a predetermined period of time, the controller 40 ascertains that the solid fuel is near the end of its combustible life. In response to the solid fuel expiring, the controller 40 communicates the expiration via the annunciator 50. For instance, in one embodiment, the controller 40 may activate an LED (not shown) affixed to the housing The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A control system for a solid fuel combustion appliance, the appliance including a housing defining a combustion chamber, the housing defining an inlet, an outlet, and an opening, each in fluidic communication with the combustion chamber, and an inlet damper movable between a plurality of positions for controlling airflow into the inlet, and a door operatively connected to the housing and positionable in a closed position to block the opening, said control system comprising:

a drive mechanism operatively connected to the inlet damper for controlling the position of the inlet damper;

an exhaust temperature sensor for measuring the temperature of air exhausted through the outlet;

a switch coupled to the housing for providing a signal when the door opens or closes; and a controller in communication with said drive mechanism and said exhaust temperature sensor, and with said controller configured to receive the signal from said switch;

said controller is configured to determine whether the door has been opened and reclosed based on the signals from the switch;

said controller is configured to control said drive mechanism in an automatic mode to automatically position the inlet damper at a predetermined open position for a predetermined and limited period of time regardless of a predetermined temperature and as programmed in accordance with the automatic mode in response to said controller determining that the door has been opened and reclosed, and wherein said period of time is programmed to be within a range defined between 30 seconds and 2 minutes; and wherein after expiration of the period of time said controller is configured to control said drive mechanism in the automatic mode to automatically position the inlet damper to maintain the predetermined temperature of air exhausted through the outlet.

2. A control system as set forth in claim 1 wherein the solid fuel combustion appliance further includes a catalyst and said control system further includes a catalyst temperature sensor in communication with said controller for measuring the temperature of air passing through said catalyst.

3. A control system as set forth in claim 2 wherein said controller analyzes the temperature of the air passing through the outlet and the temperature of the air passing through the catalyst to determine if both temperatures fall by a predetermined amount.

4. A control system as set forth in claim 3 further comprising an annunciator in communication with said controller and wherein said controller activates said annunciator in response to determining that both temperatures have fallen by the predetermined amount.

5. A control system as set forth in claim 1 wherein the appliance includes a fan for blowing air from the combustion chamber to a space outside the housing and wherein said controller is in communication with the fan for controlling operation of the fan.

6. A control system as set forth in claim 1 further comprising a remote control device in communication with said controller for controlling operation of said controller.

7. A solid fuel combustion appliance comprising:

a housing defining a combustion chamber;

said housing defining an inlet, and outlet, and an opening, each in fluidic communication with said combustion chamber;

a door operatively connected to said housing and positionable in a closed position to block said opening;

an inlet damper movable between a plurality of positions for controlling airflow into said inlet;

a drive mechanism operatively connected to said inlet damper for controlling the position of said inlet damper;

an exhaust temperature sensor for measuring the temperature of air exhausted through said outlet;

a switch coupled to said housing for providing a signal when said door opens or closes; and a controller in communication with said drive mechanism and said exhaust temperature sensor, and with said controller configured to receive the signal from said switch;

said controller is configured to determine whether the door has been opened and reclosed based on the signals from the switch;

said controller is configured to control said drive mechanism in an automatic mode to automatically position the inlet damper at a predetermined open position for a predetermined and limited period of time regardless of a predetermined temperature and as programmed in accordance with the automatic mode in response to said controller determining that the door has been opened and reclosed, and wherein said period of time is programmed to be within a range defined between 30 seconds and 2 minutes; and wherein after expiration of the period of time said controller is configured to control said drive mechanism in the automatic mode to automatically position the inlet damper to maintain the predetermined temperature of air exhausted through the outlet.

8. A solid fuel combustion appliance as set forth in claim 7 further including a catalyst and a catalyst temperature sensor in communication with said controller for measuring the temperature of air passing through said catalyst.

9. A solid fuel combustion appliance as set forth in claim 8 wherein said controller analyzes the temperature of the air passing through said outlet and the temperature of the air passing through said catalyst to determine if both temperatures fall by a predetermined amount.

10. A solid fuel combustion appliance as set forth in claim 9 further comprising an annunciator in communication with said controller and wherein said controller activates said annunciator in response to determining that both temperatures have fallen by the predetermined amount.

11. A control system as set forth in claim 1 wherein the predetermined open position is different than the position for maintaining the predetermined temperature.

12. A control system as set forth in claim 1 wherein the predetermined open position is fully open.

13. A solid fuel combustion appliance as set forth in claim 7 wherein the predetermined open position is different than the position for maintaining the predetermined temperature.

14. A solid fuel combustion appliance as set forth in claim 7 wherein the predetermined open position is fully open.

15. A control system as set forth in claim 1 wherein said controller is further configured to operate in a manual mode and wherein said controller is configured to receive a selection between the manual mode and the automatic mode via a remote control device in wireless communication with said controller.

16. A solid fuel combustion appliance as set forth in claim 7 wherein said controller is further configured to operate in a manual mode and wherein said controller is configured to receive a selection between the manual mode and the automatic mode via a remote control device in wireless communication with said controller.

17. A solid fuel combustion appliance as set forth in claim 7 wherein said controller is further configured with one of a proportional-integral (PI) control loop and a proportional-integral-derivative (RID) control loop to automatically position the inlet damper.

* * * * *